US007789702B1

(12) United States Patent
Xiang et al.

(10) Patent No.: US 7,789,702 B1
(45) Date of Patent: Sep. 7, 2010

(54) ELECTRICAL CONNECTOR WITH BOARD LOCK WHICH IS INTEGRALLY FORMED ON A METAL SHELL

(75) Inventors: Xing-Hai Xiang, Kunshan (CN); Lun-Song Hu, Kunshan (CN); Zi-Qiang Zhu, Kunshan (CN); Bo Yang, Kunshan (CN); Jia-Wei Gu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/567,074

(22) Filed: Sep. 25, 2009

(30) Foreign Application Priority Data

Jun. 2, 2009 (CN) ..... 2009 2 0303898

(51) Int. Cl.
*H01R 13/60* (2006.01)

(52) U.S. Cl. ..... 439/567

(58) Field of Classification Search ..... 439/567, 439/607.4, 607.34, 607.38, 607.39, 607.37, 439/607.55, 362
See application file for complete search history.

(56) References Cited

U.S. PATENT DOCUMENTS 5,147,220 A * 9/1992 Lybrand ..... 439/567
5,921,811 A * 7/1999 Hsu ..... 439/567
6,083,043 A * 7/2000 Lok ..... 439/567
6,095,853 A * 8/2000 Huang et al. ..... 439/541.5
6,171,142 B1 1/2001 Wang et al.
6,210,218 B1 * 4/2001 Chang ..... 439/567
6,402,554 B1 * 6/2002 Yeh ..... 439/607.39
7,018,237 B2 * 3/2006 Zhan et al. ..... 439/607.55
7,128,582 B2 * 10/2006 Fang et al. ..... 439/79

* cited by examiner

*Primary Examiner*—Phuong K Dinh
(74) *Attorney, Agent, or Firm*—Wei Te Chung; Andrew C. Cheng; Ming Chieh Chang

(57) ABSTRACT

An electrical connector (100) includes an insulative housing (1), a number of contacts (2) retained in the insulative housing (1) and a front metal shell (3) covering a front side of the insulative housing (1). The insulative housing (1) has a body portion (11), and a positioning slot (141) located at a lower side thereof. The front metal shell (3) has a base portion (31) and a board lock (5) integrally extending backwardly from a lower end of the base portion (31). The board lock (5) has a flat securing portion (51) which is received in the positioning slot (141) for preventing the board lock (5) from moving along an up to down direction, and a locking leg (52) bending downwardly from an inner side of the securing portion (51).

8 Claims, 6 Drawing Sheets

ELECTRICAL CONNECTOR WITH BOARD LOCK WHICH IS INTEGRALLY FORMED ON A METAL SHELL

BACKGROUND OF THE INVENTION

1. Field of the Invention

The present invention relates to an electrical connector, more particularly to an electrical connector with board lock.

2. Description of Related Art

Electrical connectors have been employed to connect a printed circuit board in various electronic components associated with a computer, such as a hard disk drive, a printer, etc. Such an electrical connector usually has an insulative housing, a plurality of contacts retained in the insulative housing and soldered on the printed circuit board, a metal shell covering the insulative housing and a pair of board locks retained on the insulative housing and the metal shell for positioning the electrical connector to the printed circuit board.

The insulative housing usually has a mating portion and a pair of mounting holes at two sides of the mating portion. The metal shell has a pair of openings corresponding to the mounting holes. Each board lock has a securing portion affixed to a rear side of the mounting holes and a pair of mounting legs extending downwardly for locking the electrical connector to the printed circuit board. The securing portion defines a through hole corresponding to the mounting hole. Besides, the electrical connector has a nut with a cylinder portion extending through the through hole, mounting hole and opening and fastening the board lock, insulative housing and metal shell together. But in process of assembling the electrical connector to the printed circuit board, the board lock is easily distorted as being resisted by the printed circuit board or became less crowded with the insulative housing and the shell. When a corresponding plug is inserted or pulled out of the electrical connector more times, the electrical connector is easily pulled upwardly, and the board lock will not fasten the metal shell and the insulative housing to the printed circuit board, which is very inconvenient to users. In addition, the electrical connector is difficult to be assembled because of a mass of components it has.

Hence, an improved electrical connector with a stable board lock is desired to overcome the above problems.

BRIEF SUMMARY OF THE INVENTION

According to one aspect of the present invention, an electrical connector comprises an insulative housing, a plurality of contacts retained in the insulative housing and a front metal shell covering a front side of the insulative housing; the insulative housing has a body portion, and a positioning slot located at a lower side thereof; the front metal shell has a base portion and a board lock integrally extending backwardly from a lower end of the base portion; the board lock has a flat securing portion which is received in the positioning slot for preventing the board lock from moving along an up to down direction, and a locking leg bending downwardly from an inner side of the securing portion.

According to another aspect of the present invention, a metal shell used on an electrical connector comprises a flat base portion affixed on a front side of the electrical connector and a plurality of flanges extending backwardly from upper and lower ends thereof; the base portion has a pair of cylinders extending backwardly for fastening the metal shell to the electrical connector; a pair of board lock integrally extend backwardly from the flanges of the lower end of the base portion respectively; the board lock has a flat securing portion and a locking leg bending downwardly from an inner side of the securing portion.

Other objects, advantages and novel features of the present invention will become more apparent from the following detailed description of the present embodiment when taken in conjunction with the accompanying drawings.

DETAILED DESCRIPTION OF THE PREFERRED EMBODIMENTS

Figure 1:
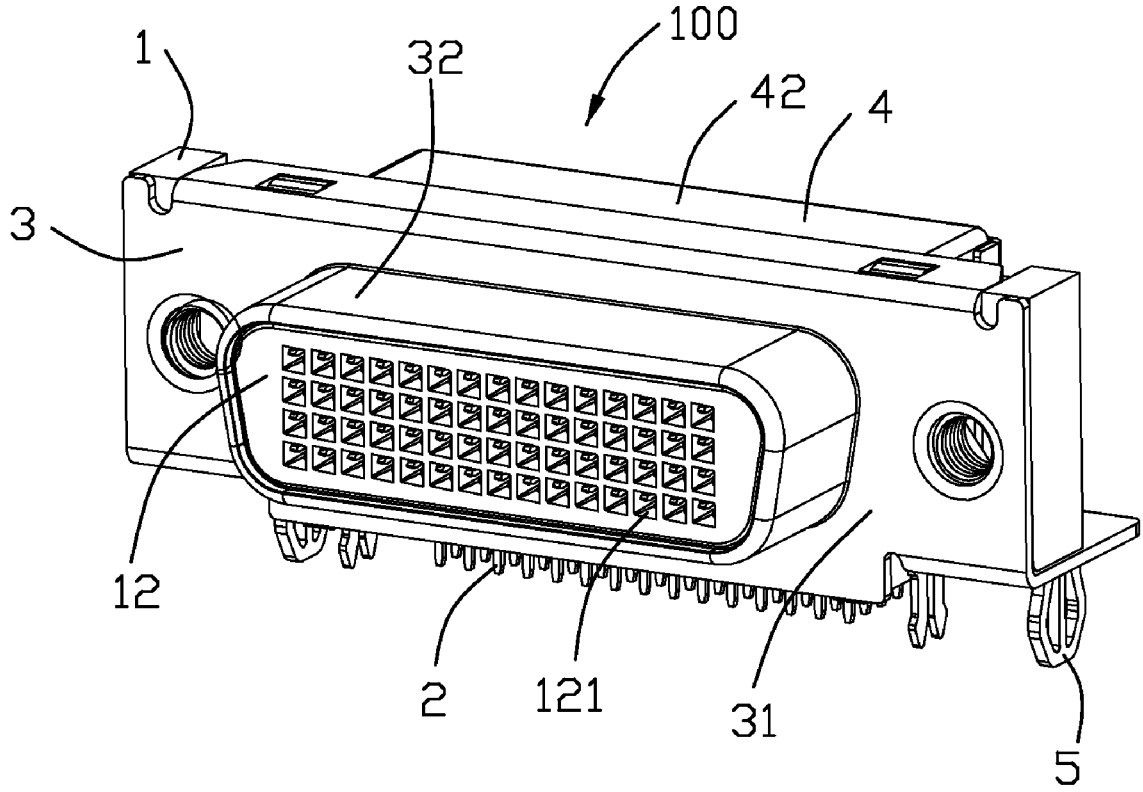
FIG. 1 is a perspective view of an electrical connector according to the present invention.

Reference will be made to the drawing figures to describe the present invention in detail, wherein depicted elements are not necessarily shown to scale and wherein like or similar elements are designated by same or similar reference numeral through the several views and same or similar terminology.

Figure 2:
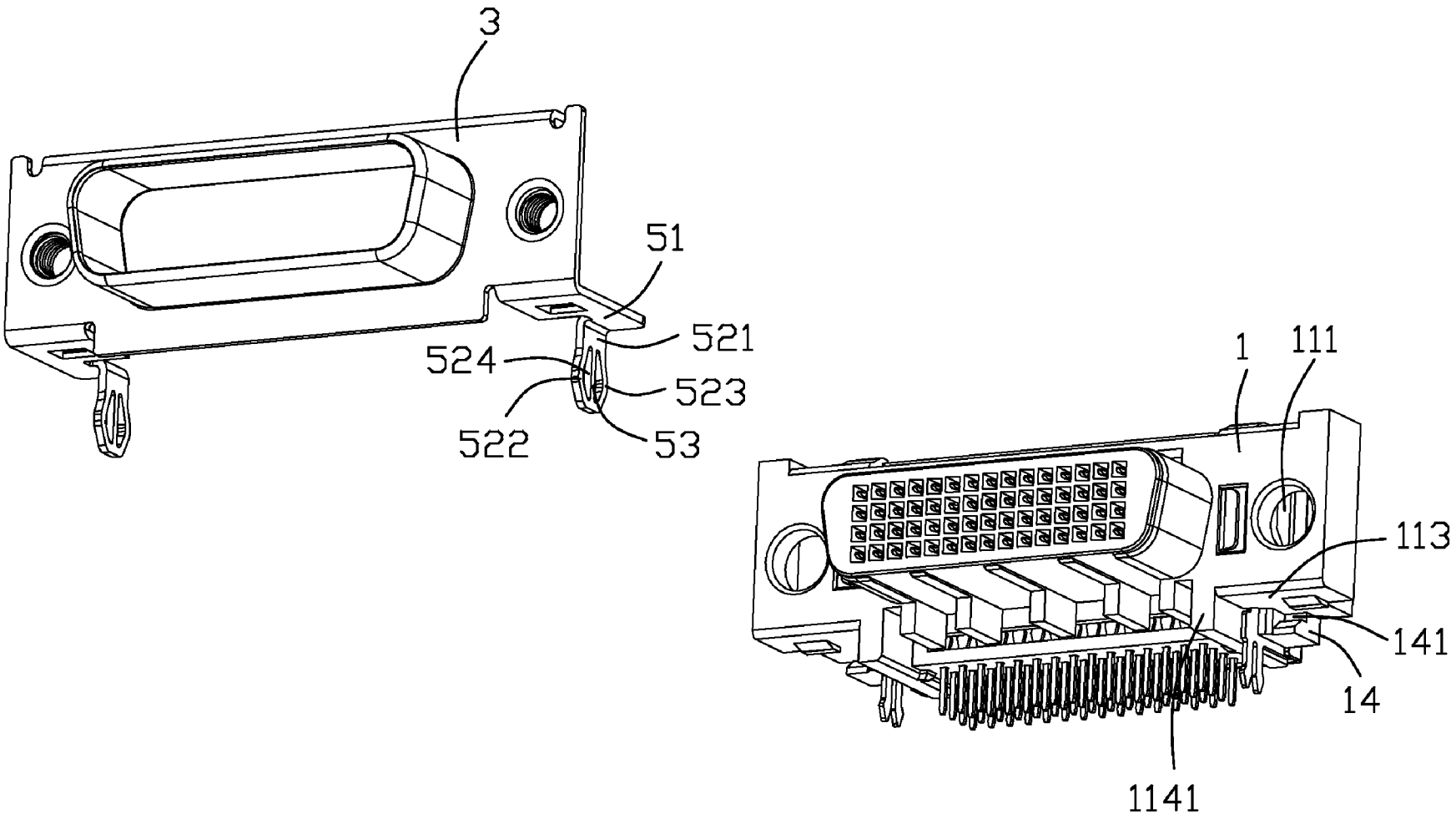
FIG. 2 is a partially exploded view of the electrical connector shown in FIG. 1.
Figure 3:
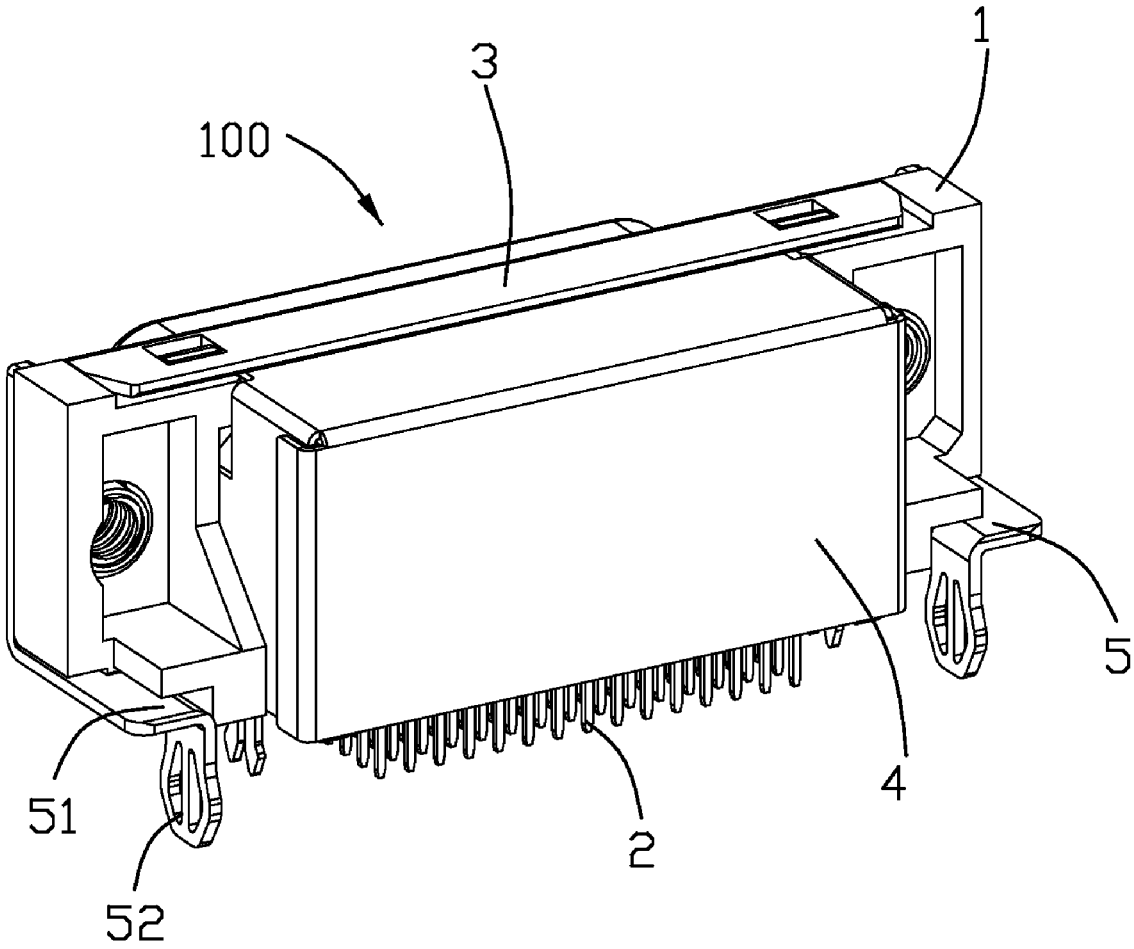
FIG. 3 is a view similar to FIG. 1, while taken from another aspect.
Figure 4:
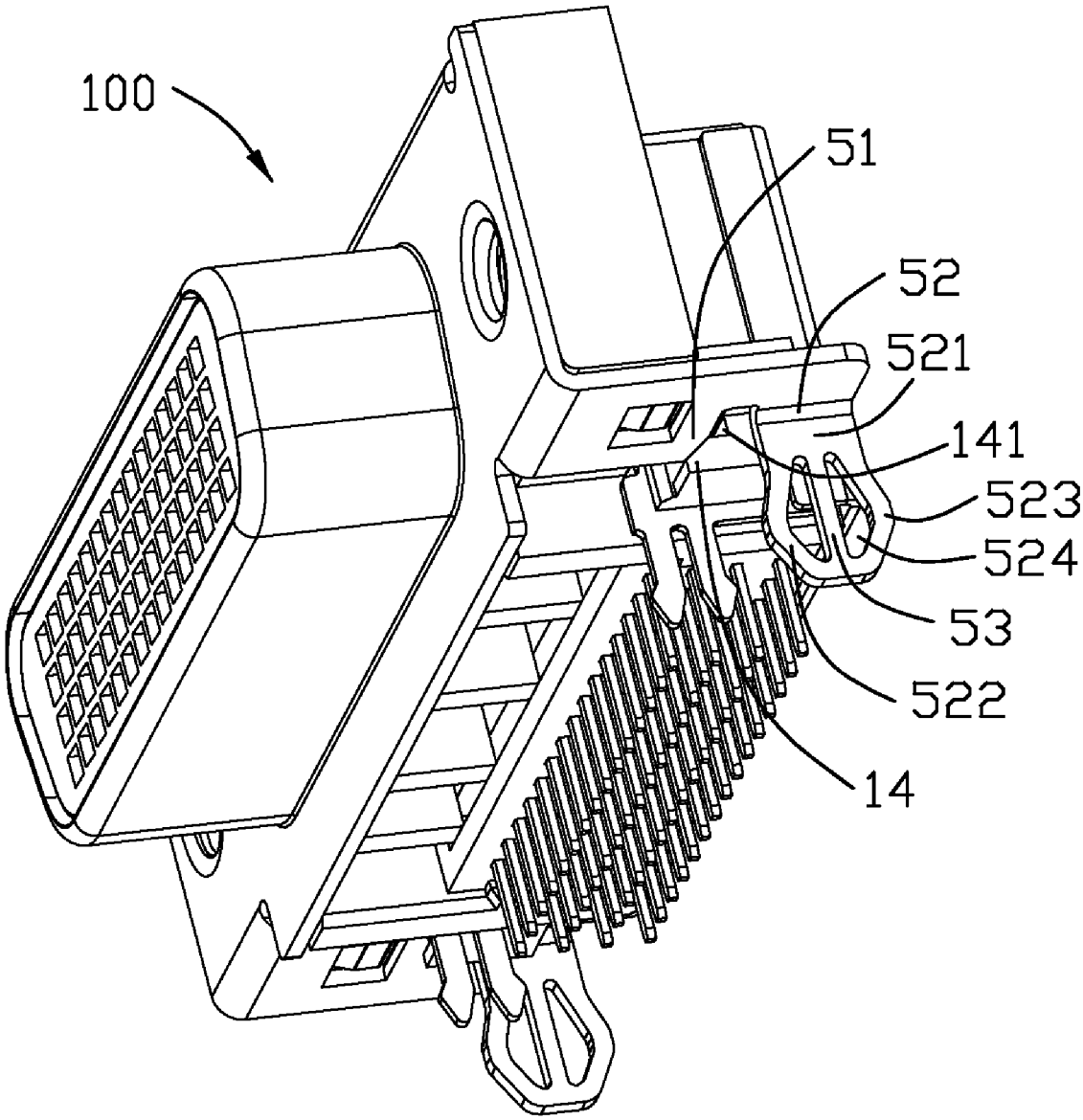
FIG. 4 is a view similar to FIG. 1, while taken from a third aspect.
Figure 5:
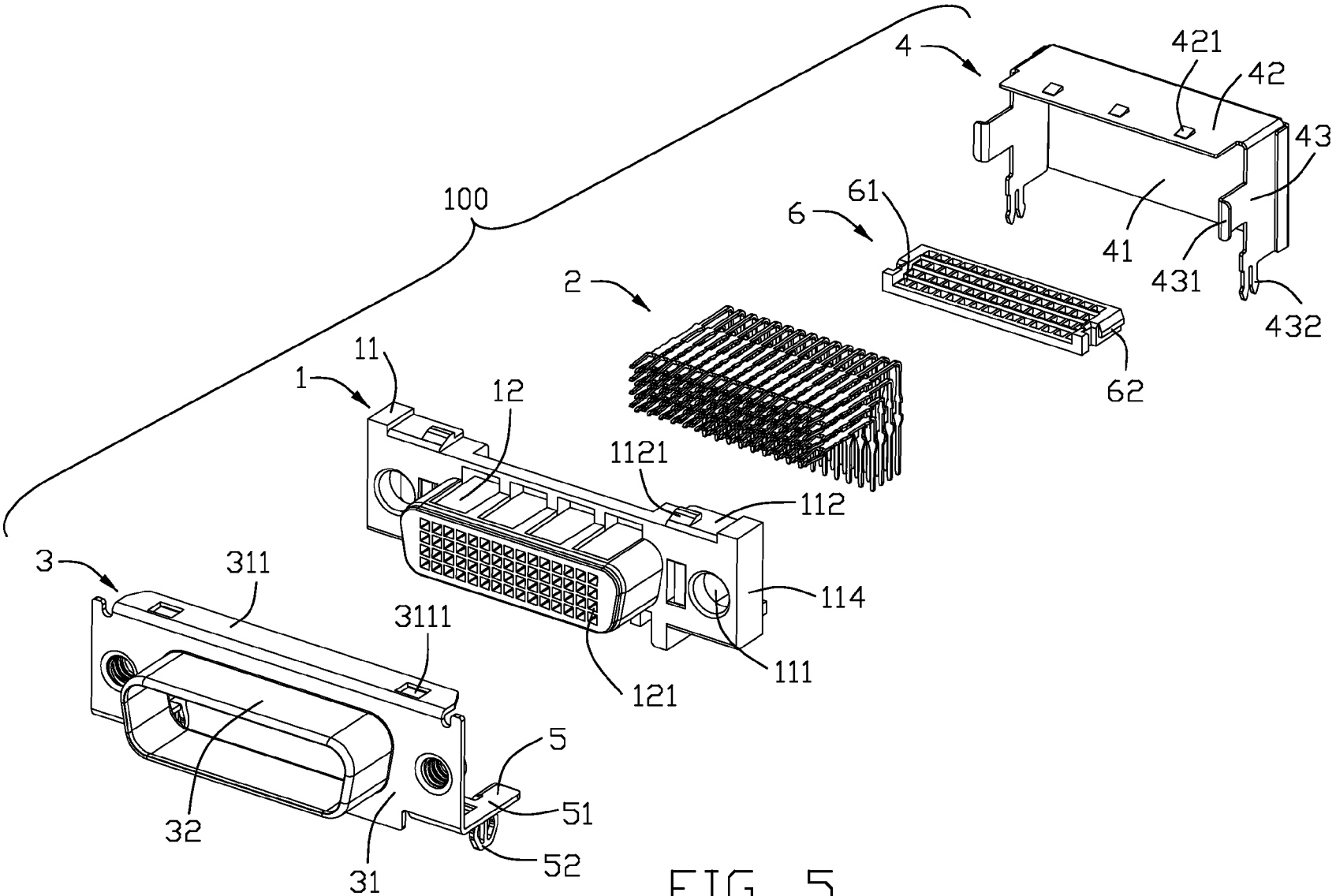
FIG. 5 is an exploded view of the electrical connector shown in FIG. 1.
Figure 6:
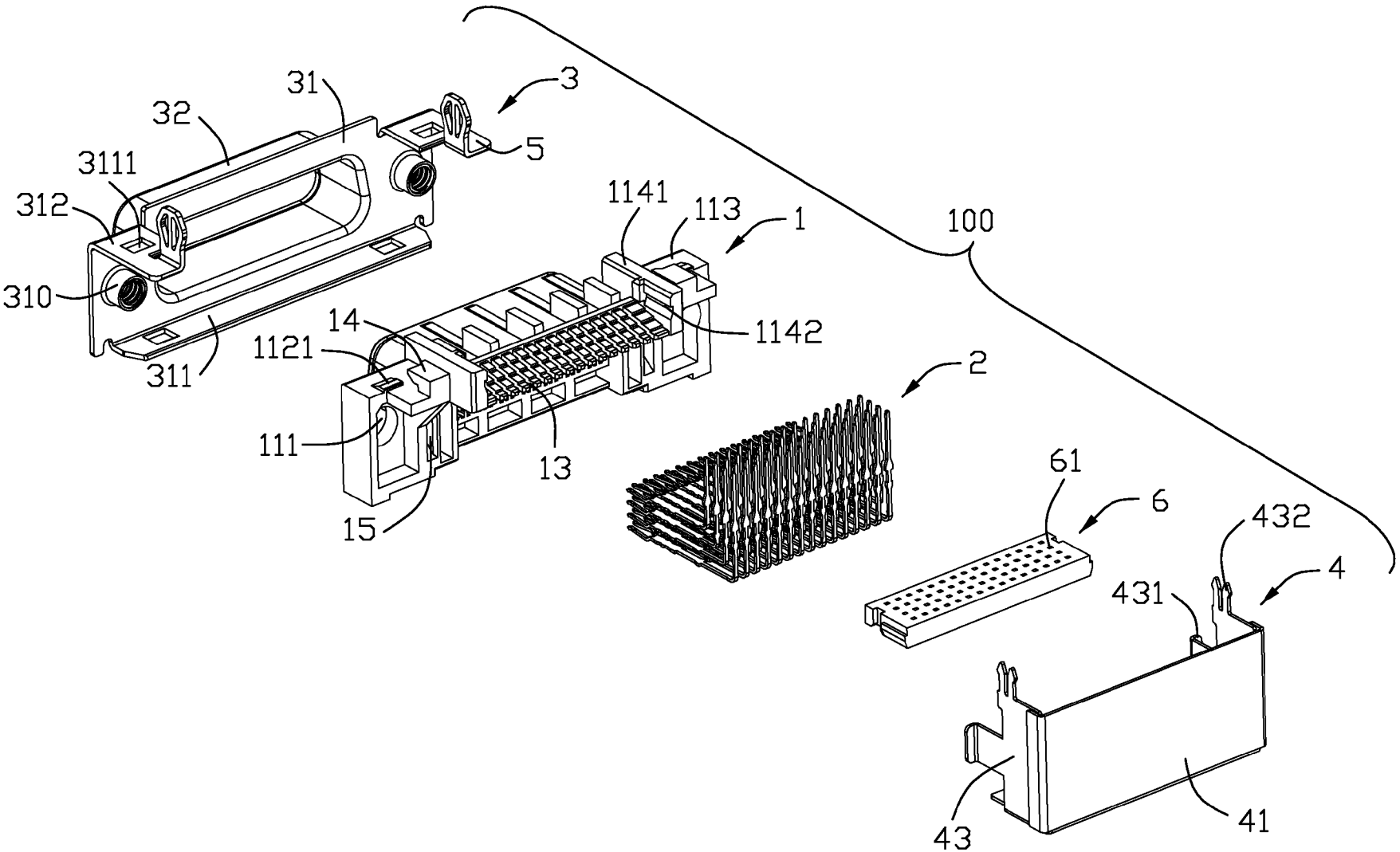
FIG. 6 is a view similar to FIG. 5, while taken from a different aspect.

Referring to FIGS. 1-6, an electrical connector 100 for connecting to a printed circuit board (not shown) according to the present invention is disclosed. The electrical connector 100 comprises an insulative housing 1, a plurality of contacts 2 retained in the insulative housing 1, a front metal shell 3 covering a front side of the insulative housing 1, a rear metal shell 4 covering a rear side of the insulative housing 1 and a spacer 6 mounted on a lower side of the insulative housing 1 for positioning the contacts 2.

The insulative housing 1 has a body portion 11 and a mating portion 12 extending forwardly from a middle portion of the body portion 11 for connecting with a corresponding plug (not shown). The mating portion 12 defines a plurality of passageways 121 extending through the insulative housing 1 along a front to back direction. The body portion 11 defines a pair of mounting holes 111 respectively located at two sides of the mating portion 12, and a pair of locking holes 15 respectively disposed between the mounting hole 111 and the mating portion 12. The mounting holes 111 and the locking holes 15 extend through the body portion 11 along the front to back direction.

The body portion 11 has a pair of opposite top wall 112 and bottom wall 113, and a pair of side walls 114 between the top and bottom walls 112, 113. The top and bottom walls 112, 113 each has a plurality of protrusions 1121 extending outwardly for engaging with the front metal shell 3. The body portion 11 has a pair of blocks 1141 extending downwardly from the bottom wall 113. Each block 1141 defines a slot 1142 extending along the front to back direction for positioning the spacer 6 between the blocks 1141. A pair of projections 14 extend downwardly and forwardly from the bottom wall 113 and are located at outsides of the blocks 1141 respectively. A pair of portioning slots 141 are formed between the projections 14 and the bottom wall 113 and opens to exterior at a front side thereof. Each projection 14 is formed with an inclined face at a front side thereof for leading the front metal shell 3 moving into the portioning slots 141. The protrusions 1121 on the bottom wall 113 are located at a front side of the projections 14. Besides, the insulative housing 1 has a plurality of partition blocks 13 extending backwardly from a rear side thereof. The partition blocks 13 are spaced apart from each other to form a plurality of grooves therebetween for receiving the contacts 2 and preventing the contacts 2 from contacting with each other.

The spacer 6 has a pair of locking ribs 62 projecting outwardly from two sides thereof to engage with the slots 1142 for being mounted between the blocks 1141, and a plurality of through holes 61 for positioning the contacts 2.

The contacts 2 each defines a first end extending into the passageways 121 for connecting with the corresponding plug, and a second end perpendicular to the first end extending through the through holes 61 for soldering on the printed circuit board.

The front metal shell 3 is stamped by a piece of metal sheet and has a shape corresponding to a front side of the insulative housing 1. The front metal shell 3 has a flat base portion 31 affixing to a front side of the body portion 11, a sleeve 32 extending forwardly from the base portion 31 and ringing on the mating portion 12, and a pair of board locks 5 integrally extending backwardly from a lower end of the base portion 31. The base portion 31 has a pair of cylinders 310 extending backwardly from the base portion 31 and received in the mounting holes 111, and a plurality of horizontal flanges 311, 312 bending backwardly from upper and lower ends thereof. The cylinders 310 define a plurality of whorls at an inner side thereof for locking with a nut (not shown). The horizontal flanges 311, 312 define a plurality of openings 3111 engaging with the protrusions 1121 for fixing the front metal shell 3 to the insulative housing 1.

Each board lock 5 has a flat securing portion 51 extending horizontally and backwardly from the flange 312 at the lower end of the front metal shell 3, and a locking leg 52 bending downwardly from an inner side of the securing portion 51. The securing portion 51 extends into the positioning slot 141 from a front side of the positioning slots 141 along the inclined face, therefore, the bottom wall 113 of the insulative housing 1 can prevents the board lock 5 from moving upwardly when the board lock 5 is resisted by the printed circuit board, and the projection 14 can support securing portion 51 and prevent the board lock 5 from drawing downwardly when the electrical connector 100 is pulled out of the printed circuit board. The securing portion 51 can be fastened in the positioning slot 141 stably.

The locking leg 52 has a base 521 connecting with the securing portion 51 and a pair of first and second legs 522, 523 extending downwardly from two sides of the base 521. The first and second legs 522, 523 present as arc shape and connect with each other at lower ends thereof to form a orbicular leg which has a high elasticity and intension for locking in the printed circuit board stably. Besides, the locking leg 52 has a middle leg 53 extending perpendicularly downwardly from a middle portion of the base 521 and located between the first and second legs 522, 523. The middle leg 53 connects with lower ends of the first and second legs 522, 523 and forms two triangular openings with the first and second legs 522, 523, therefore, other components (not shown) or other board locks 5 can not extend into the orbicular leg and distort the orbicular leg when plating a plurality of front metal shells 3 and other components together. Of course, the middle leg 53 can only extend downwardly between the first and second legs 522, 523, and not connect with the lower ends of the first and second legs 522, 523, which can also prevent other components or other board locks 5 from extending into the orbicular leg and distorting the orbicular leg. The first leg 522, the second leg 523 and the middle leg 53 are located at a same plane.

The rear metal shell 4 has a top wall 42 having a plurality of spring tabs 421 to engage with the front metal shell 3, a pair of side walls 43 bending downwardly from two sides of the top wall 42, and a rear wall 41 bending downwardly from the rear end of the top wall 42. Each side wall 43 has a finger 431 extending forwardly from a front side thereof and a pair of mounting legs 432 extending downwardly from a lower end thereof. The finger 431 extends through the locking hole 15 and locks with a front side of the locking hole 15 for fixing the rear metal shell 4 to the insulative housing 1.

As fully described above, the electrical connector 100 in the present invention comprises the front metal shell 3 which is integrally formed with the pair of board locks 5, and the insulative housing 1 with the positioning slots 141 at lower side thereof to position the board locks 5 therein for preventing the board locks 5 from moving along an up to down direction. The board locks 5 can be fixed on the insulative housing 1 stably and can not be distorted. In addition, the electrical connector 100 has less components which can be assembled easily.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. An electrical connector, comprising:

an insulative housing having a body portion, and a positioning slot located at a lower side of the insulative housing;

a plurality of contacts retained in the insulative housing; and a front metal shell covering a front side of the insulative housing, the front metal shell having a base portion and a board lock integrally extending backwardly from a lower end of the base portion, the board lock having a flat securing portion which is received in the positioning slot for preventing the board lock from moving along an up to down direction, and a locking leg bending downwardly from an inner side of the securing portion, wherein the insulative housing has a pair of opposite top wall and bottom wall and a projection extending downwardly and forwardly from the bottom wall, the positioning slot is formed between the bottom wall and the projection and opens to exterior at a front side thereof, wherein the projection is formed with an inclined face at a front side thereof for leading the securing portion into the positioning slot, wherein the front metal shell has a plurality of horizontal flanges bending backwardly from upper and lower ends of the base portion, and the securing portion of the board lock connects with the flange of the lower end and extending horizontally and backwardly.

2. The electrical connector as claimed in claim 1, wherein each top wall and bottom wall has a plurality of protrusions extending outwardly, the flanges define a plurality of openings engaging with the protrusions for positioning the front metal shell on the insulative housing.

3. The electrical connector as claimed in claim 1, wherein the insulative housing has a mating portion extending forwardly from a middle portion of the body portion and a pair of mounting holes extending through along a front to back direction and located at two sides of the mating portion, the front metal shell defines a pair of cylinders extending backwardly and received in the mounting holes.

4. The electrical connector as claimed in claim 3, wherein the insulative housing defines a pair of locking holes respectively distributed between the mounting holes and the mating portion and extending through the body portion along a front to back direction.

5. The electrical connector as claimed in claim 4, further comprising a rear metal shell covering a rear side of the insulative housing and the contacts, the rear metal shell has a top wall having a plurality of spring tabs for engaging with the front metal shell, a pair of side walls bending downwardly from two sides of the top wall, and a rear wall bending downwardly from the rear end of the top wall, each side wall has a finger extending through the locking hole for fixing the rear metal shell to the insulative housing and a pair of mounting legs extending downwardly.

6. The electrical connector as claimed in claim 4, wherein the locking leg is offset from the mounting leg which is located at a same side with the locking leg along both a width direction and the front to back direction for firmly fastening the electrical connector to a printed circuit board.

7. A metal shell used on an electrical connector comprising:

a flat base portion affixed on a front side of the electrical connector and a plurality of flanges extending backwardly from upper and lower ends thereof, the base portion having a pair of cylinders extending backwardly for fastening the metal shell to the electrical connector; and a pair of board lock integrally extending backwardly from the flanges of the lower end of the base portion respectively, the board lock having a flat securing portion and a locking leg bending downwardly from an inner side of the securing portion, wherein the locking leg comprises a base and a first leg and a second leg extending downwardly from two sides of the base, the first leg and the second leg present as arc shape and connect with each other at lower ends thereof, wherein the locking leg has a middle leg extending downwardly from a middle portion of the base and located between the first and second legs, the middle leg, the first leg and the second leg are located at a same plane.

8. An electrical connector comprising:

an insulative housing defining a main body with a plurality of passageways therein, and a pair of blocks at two opposite longitudinal ends thereof;

a plurality of contacts disposed in the corresponding passageways, respectively;

a front metallic shell shielding a front face of the housing and equipped with a pair of first board locks around the pair of blocks, respectively; and a rear metallic shell shielding a rear face of the housing and equipped with a pair of second board locks around the pair of blocks, respectively; wherein one of first board locks and one of second board locks are respectively located by opposite inner and outer sides of the corresponding block, wherein the pair of first board locks are located by the outer sides of the corresponding blocks, respectively, wherein the pair of second board locks are located by the inner sides of the corresponding blocks, respectively, wherein each of the pair of second board locks is essentially located between the main body and the corresponding block in a transverse direction, wherein said rear metallic shell is assembled to the housing forwardly, wherein said rear metallic shell defines a pair of fingers latchably inserted into corresponding holes of the housing, respectively, wherein said rear metallic shell mechanically and electrically engages the front metallic shell.

* * * * *